United States Patent [19]

Reithner

[11] 4,098,322

[45] Jul. 4, 1978

[54] STARTER BAR TO BE USED IN CONTINUOUS CASTING PLANTS

[75] Inventor: Gerhard Reithner, Linz, Austria

[73] Assignee: Vereinigte Osterreichische Eisen- und Stahlwerke - Alpine Montan Aktiengesellschaft, Vienna, Austria

[21] Appl. No.: 784,833

[22] Filed: Apr. 5, 1977

[30] Foreign Application Priority Data

Apr. 30, 1976 [AT] Austria ..... 3174/76

[51] Int. Cl.[2] ..... B22D 11/08

[52] U.S. Cl. ..... 164/446; 164/426

[58] Field of Search ..... 164/274, 82, 425, 426, 164/447, 448, 82, 445, 446

[56] References Cited

U.S. PATENT DOCUMENTS 3,593,776 7/1971 Williamson ..... 164/274

3,593,792 7/1971 Hess ..... 164/274

FOREIGN PATENT DOCUMENTS 205,322 6/1966 Sweden ..... 164/274

*Primary Examiner*—Francis S. Husar
*Assistant Examiner*—John S. Brown
*Attorney, Agent, or Firm*—Burns, Doane, Swecker & Mathis

[57] ABSTRACT

A starter bar to be used in continuous casting plants for extracting cast strands has a starter bar head and articulately interconnected link bodies following upon the starter bar head, and at least one of these link bodies is divided between the joints connecting it with the neighboring link bodies and the link body parts thus formed are braced together by laterally arranged connecting elements.

5 Claims, 5 Drawing Figures

Figure 4:
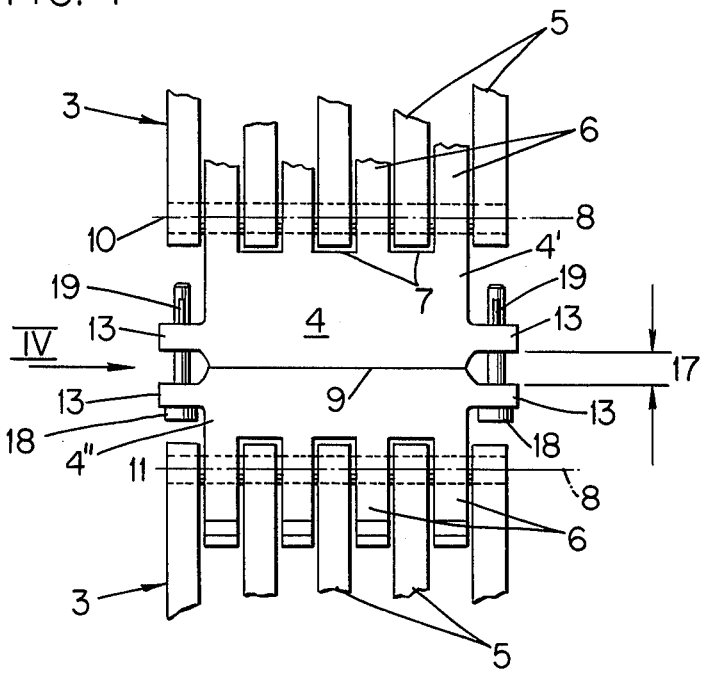

FIG. 1
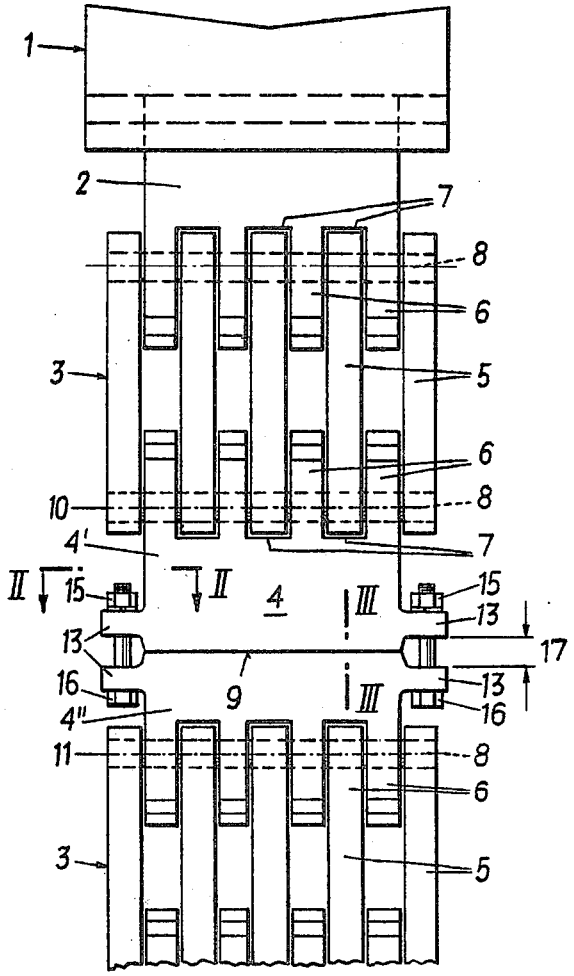
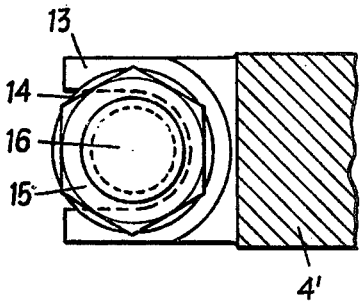
FIG. 2
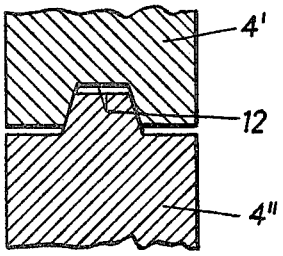
FIG. 3

STARTER BAR TO BE USED IN CONTINUOUS CASTING PLANTS

The invention relates to a starter bar for extracting cast strands in continuous casting plants, with a starter bar head and articulately connected link bodies following thereupon.

In continuous casting plants it can happen during casting that the strand skin breaks due to operational disturbances. The danger of such a break-through of the strand is especially immanent when the operation is started, while the cast strand is extracted from the mould with the help of the starter bar. The steel flowing out in case of such a damage welds together the starter bar head and the first links of the starter bar following upon the starter bar head with the strand guide rollers of the strand guide path. Because of the poor access a repair requires a lot of time and work. At first the part of the starter bar which has not been damaged must be separated from that part which has welded together with the stationary parts of the plant. Hitherto this has been done in a torch cutting step, by which one link body of the starter bar has been destroyed and additional costs have been incurred.

A further problem is to be found in continuous casting plants which are equipped for producing cast strands of various thicknesses. In such plants, one and the same starter bar can be used for differing strand thicknesses within certain regions of thickness, wherein the starter bar head corresponding to the respective casting thickness is connected to the link bodies of the starter bar. If the difference in thickness between the starter bar head and the link bodies is very great, a number of transition link bodies expanding wedge-like towards the starter bar head must be present, which can be exchanged together with the starter bar head. Hitherto, the exchange of these transition link bodies has been effected by removing the bolts connecting the link bodies. In most cases, this removal proved to be extremely difficult because of fitting rust or slight deformations, respectively, and necessitated a repair by drilling open the bores for the bolts and fitting in a bolt having a wider diameter.

The invention aims at avoiding these disadvantages and difficulties and has as its object to provide a starter bar of the above defined kind which can easily and without requiring a lot of time and work be divided into two or more parts transversely to its longitudinal axis and assembled again. This is to enable a simple exchange of individual or a number of link bodies, a separation of the starter bar into a number of parts as well as the resetting of the starter bar to various strand thicknesses in a simple manner.

According to the invention, this object is achieved in that at least one link body is separated between the joints connecting it with the neighbouring link bodies and the link body parts are braced together with laterally arranged connecting elements, such as screw bolts or bracing anchors.

Advantageously, the link body parts are centered relative to each other by a groove and tongue fit.

According to a preferred embodiment, the link body parts are provided with lateral brackets arranged opposite each other and at a distance from each other at both sides of the plane of partition, wherein the brackets can be braced together by screw bolts.

Figure 5:
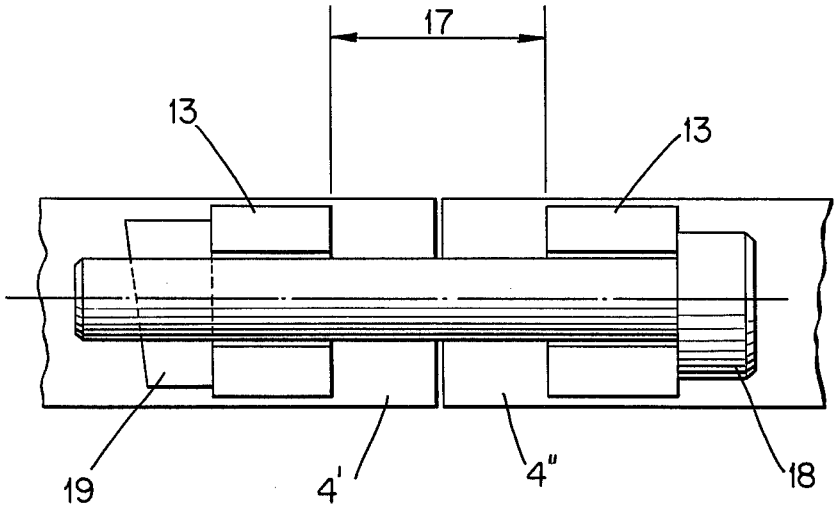

The invention shall now be described in more detail by way of an exemplary embodiment and with reference to the accompanying drawing, wherein:

FIG. 1 is a top view onto the head end of a starter bar, as it is preferably used in continuous slab casting plants, FIGS. 2 and 3 illustrate sections along lines II—II and III—III of FIG. 1, FIG. 4 illustrates a view similar to FIG. 3 of another embodiment of the invention, and FIG. 5 illustrates a view of the connector taken in the direction of the arrow IV.

By 1 the starter bar head is denoted, which is connected to a link chain comprised of articulately interconnected link bodies 3 and 4, via transition link bodies. The link bodies 3 are formed by brackets 5 arranged parallel to each other, which brackets engage in recesses 7 provided between projections 6 of the neighbouring link bodies 2 and 4. The projections 6 and the brackets 5 are articulately connected with each other by bolts 8 penetrating them. Between the two link bodies 3 the link body 4 designed according to the invention is arranged. The latter is divided along the plane 9 between the connection points 10 and 11 connecting it with the neighbouring link bodies 3, the two link body parts 4' and 4", as can be seen from FIG. 3, being centered against each other by a groove and tongue fit 12. Thereby the formation of a step at the broad sides, at which the starter bar is supported by the strand guide rollers of the strand guide path, is reliably avoided. In addition, a further groove-tongue-fit can be provided perpendicularly to the groove-tongue-fit 12, whereby the lateral centering of the link body parts can be safeguarded.

At the two narrow sides of the link body parts 4' and 4" brackets 13 are arranged, which oppose each other when the link body 4 is assembled. Each one of the brackets 13 is provided with a slit 14 so that screw bolts 16 provided with nuts 15 can be inserted from the side to connect always two brackets 13 opposing each other at the plane 9. Washers safeguard their good contact on the brackets 13. By tightening the nuts 15, the two link body parts 4' and 4" are braced relative to each other.

For separating the member body 4 — and thus the starter bar — only the nuts 15 have to be detached and the screw bolts 16 taken out. When this operation becomes too complicated or impossible because of rust or a poor accessibility — if the starter bar is stuck in the strand guide path and welded together with it by a break-through of the strand — the screw bolts 16 between the brackets 13 are severed, e.g. by a torch cutting step. For severing the screw bolts, the brackets are arranged at a distance 17 from each other which is chosen to be wide enough that the brackets are not damaged.

Instead of the screw bolts also other connection means can be provided, e.g. drawing anchors 18 which are braceable relative to the brackets by wedges 19.

The number of divided link bodies 4 in a starter bar depends on the respective requirements. Thus, if an easy exchageability of individual link bodies is required, the starter bar can also be completely assembled of divided link bodies 4.

I claim:

1. In an elongated starter bar to be used in continuous casting plants for extracting cast strands, of the type including a starter bar head and link bodies interconnected by joints and following upon the starter bar head, the improvement which is characterized in that at least one of the link bodies is divided between the joints connecting it with its neighboring link bodies and along a plane transverse to the longitudinal axis of said starter bar thus forming two link body parts, said parts having laterally arranged connecting elements for securing said link body parts together.

2. A starter bar as set forth in claim 1, wherein said connecting elements are screw bolts.

3. A starter bar as set forth in claim 1, wherein said connecting elements are bracing anchors which are secured to said brackets by wedges.

4. A starter bar as set forth in claim 1, wherein said link body parts are centered relative to each other by a groove-tongue-fit.

5. A starter bar as set forth in claim 2, further comprising lateral brackets provided on the link body parts opposite each other, at a distance from each other and at both sides of said plane of partition, the brackets arranged at both sides of said plane of partition and being secured to each other by said screw bolts.

* * * * *